United States Patent [19]

Snellman et al.

[11] Patent Number: 4,935,098

[45] Date of Patent: Jun. 19, 1990

[54] PRESS SECTION IN A PAPER MACHINE WITH GUIDE TRACK SUPPORT FOR CENTRAL ROLL

[75] Inventors: Yrjö Snellman, Tampere; Mauri Rantala, Nokia, both of Finland

[73] Assignee: Oy Tampella Ab, Tampere, Finland

[21] Appl. No.: 244,882

[22] Filed: Sep. 15, 1988

[30] Foreign Application Priority Data

Sep. 15, 1987 [FI] Finland ..... 874004

[51] Int. Cl.[5] ..... D21F 3/00

[52] U.S. Cl. ..... 162/273; 162/358; 162/360.1; 162/274

[58] Field of Search ..... 162/305, 358, 360.1, 162/272–274

[56] References Cited

U.S. PATENT DOCUMENTS

| | | | |
|---|---|---|---|
| 2,959,222 | 11/1960 | Hornbostel | 162/360.1 |
| 3,080,913 | 3/1963 | Hornbostel . | |
| 3,185,617 | 5/1965 | Justus . | |
| 3,565,759 | 2/1971 | Notbohm et al. | 162/358 |
| 3,600,273 | 8/1971 | McCarrick et al. | 162/358 |
| 4,036,683 | 7/1977 | Biondetti | 162/360.1 |
| 4,440,598 | 4/1984 | Koski et al. . | |
| 4,551,205 | 11/1985 | Laapotti | 162/360.1 |
| 4,608,125 | 8/1986 | Autio | 162/199 |
| 4,673,462 | 6/1987 | Laapotti | 162/360.1 |

FOREIGN PATENT DOCUMENTS

| | | |
|---|---|---|
| 1050318 | 3/1979 | Canada . |
| 2559257 | 7/1976 | Fed. Rep. of Germany . |
| 3339255 | 5/1984 | Fed. Rep. of Germany . |
| 186762 | 9/1968 | Finland . |
| 254065 | 7/1976 | Finland . |
| 66666 | 7/1984 | Finland . |
| 834717 | 6/1985 | Finland . |

OTHER PUBLICATIONS

P. 822 of "Wochenblatt fur Papierfabrikation" 22, 1984.

*Primary Examiner*—Karen M. Hastings
*Attorney, Agent, or Firm*—Pollock, Vande Sande & Priddy

[57] ABSTRACT

The compact press section in a paper machine has a frame construction with several sections and a roll arrangement. The roll arrangement comprises a roll and at least two press rolls, each forming a nip with the central roll. The press section additionally comprises members for guiding the paper web through the press section, members for guiding one or a plurality of felts and members for cleaning the central roll. The central roll is movable with regard to the frame construction through the transfer means connected with the frame construction and interlockable by the interlocks connected to the frame construction. Thus, the machine elements of the press section can be separated and the service conditions of the press section are improved.

4 Claims, 4 Drawing Sheets

PRESS SECTION IN A PAPER MACHINE WITH GUIDE TRACK SUPPORT FOR CENTRAL ROLL

BACKGROUND OF THE INVENTION

The present invention relates to the press section in a paper machine, comprising a frame construction and a roll arrangement in one or several sections. The roll arrangement comprises a central roll and at least two press rolls, each of which forms a nip with the central roll. The press section also comprises members for guiding the paper web through the press section, members for guiding one or a plurality of press fabrics or similar into contact with the press section, as well as members for cleaning the central and/or press rolls.

In present paper machine technology, compact press section constructions are preferred. Such a construction is advantageous both with regard to the paper production and to the space utilization.

Various constructions of compact press sections are known for example through the Finnish patent applications 844693 and 854959. The so-called "Flip-Top" construction manufactured by Beloit Corporation is also known. The advantages achieved by a compact press section construction also cause problems. Such are for instance problems relating to the service operations required by the press section. Such service operations are for example the press fabric exchange, service of the paper web or the fabric guide rolls, service of the doctor used as a cleaning member of the central roll, service of the jet pipes, etc.

The above press section solutions in prior known art primarily concentrate on facilitating the exchange of the fabrics and/or rolls of press sections provided with two or a plurality of press nips. With these solutions some improvement of the service conditions of the press section is in fact achieved in certain special constructions.

However, the drawbacks appearing generally in compact press sections and also in the above prior known constructions are resolved by the present invention. In fact, the mere possibility of displacing the press rolls, and members immediately relating to them, with regard to the frame constuction of the paper machine is not enough to provide a sufficient serviceability of the press section. In order to provide a compact press section, guide members of the paper web, guide members of the press fabric or the equivalent, cleaning members of the central roll etc. have to be disposed in the vicinity of the central roll, in addition to the above at least two press rolls and members relating to them.

SUMMARY OF THE INVENTION

It has now been surprisingly observed that the problems appearing in the maintenance service of the construction can be eliminated to a major degree with the aid of the present invention, which is essentially characterized in that the central roll is disposed movably with regard to the frame construction by a transfer member connected with the frame construction and interlocking with regard to the frame construction by means of interlocking means connected with the frame construction. With the central roll being disposed movably with regard to the frame construction, the service of the machine elements surrounding the central roll can be freely carried out in the free space thus provided.

The press section according to the present invention can have most versatile embodiments. A press section with two or several nips can be constructed in various manners so that the construction remains within the scope of protection of the invention. The construction according to the invention can for instance be connected with the above press sections of prior art which are known through the FI patent applications 844693 and 854959 as well as the Beloit "Flip-Top" construction. This is of course not necessary, but a press section construction embodying the invention can be achieved in some other way differing from the above construction, by immobilizing the press rolls with regard to the frame construction and by their disposition with regard to the central roll, the improved service conditions according to the invention can be achieved.

The actual displacement of the central roll can be effected either as a rotation with regard to the frame construction or as a parallel transfer, or as a combination of these two.

The invention is illustrated in detail in the following description, referring to the embodiments represented in the enclosed drawings. In the drawings

DETAILED DESCRIPTION OF THE PREFERRED EMBODIMENTS

Figure 1:
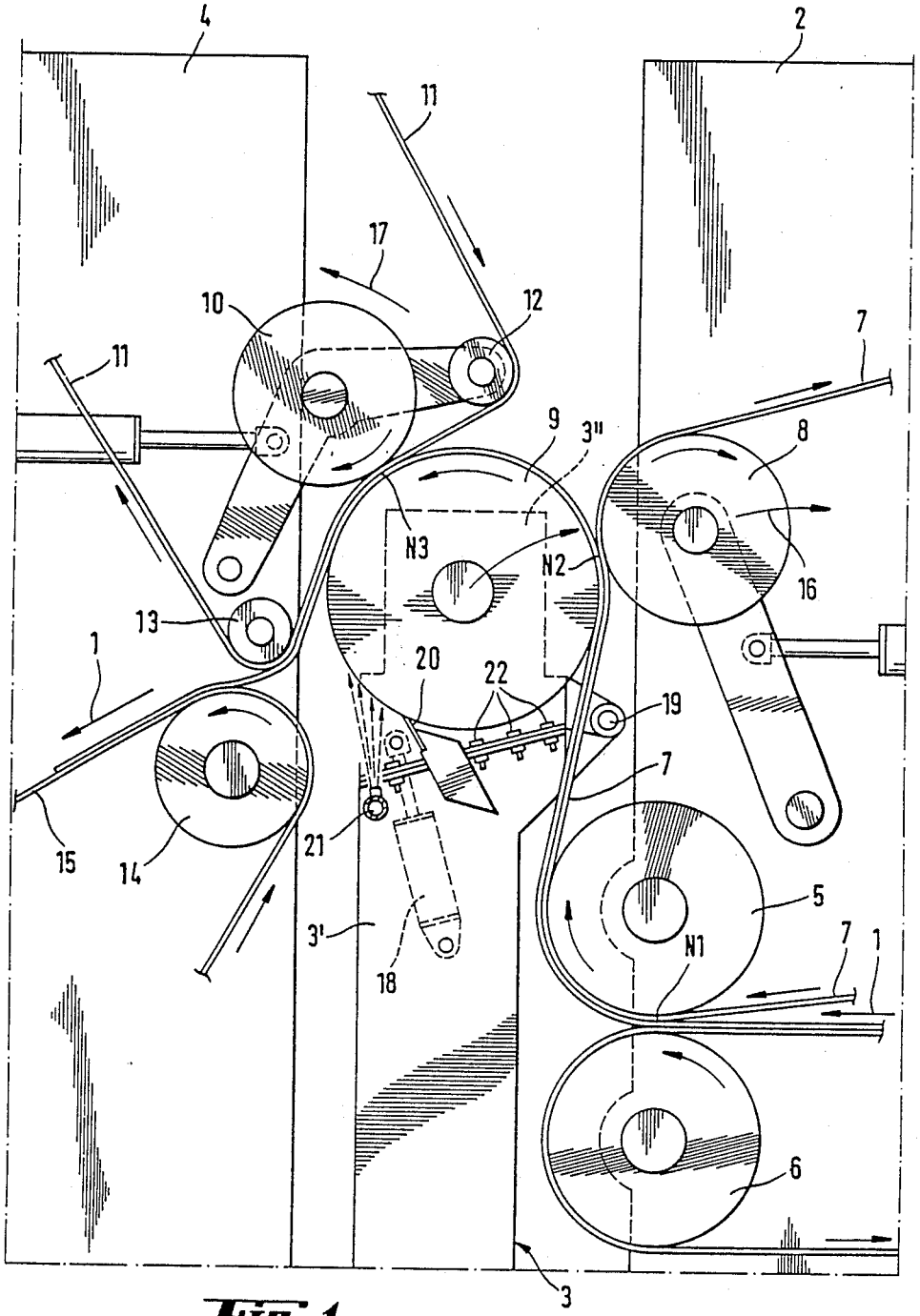
FIG. 1 shows schematically a first embodiment of the press section in operating position.

The press section in a paper machine according to the drawings comprises a frame construction (outlined by dotted lines in order to illustrate the essential features of the invention), comprising, in the direction of motion of the paper web (arrow 1), a first front frame section 2, a second so-called central frame frame section 3, section and a third rear frame section 4. The real press section is essentially on the level of the central frame section 3 between the first frame section 2 and the third frame section 4. In the described embodiment the press section comprises three nips N1, N2 and N3. The first press roll 5 forms the first nip with the counter-roll 6, which is only outlined. The press roll 5 is placed inside the endless felt 7 included in the first frame section 2 or the equivalent. The paper web is guided to the press section by the felt 7 and the press roll 5 upwards according to the figure to the second nip N2, formed by the second press roll 8 together with the central roll 9. The press roll 8 is inside the endless felt 7 and the felt 7 or the equivalent is removed from the press section over the press roll 8 to the right. The paper web advances on the upper surface of the central roll 9 to the third nip N3, formed by the third press roll 10 together with the central roll 9. At this point, an endless felt 11 belonging to the third frame section 4 passes between the press roll 10 and the paper web, being directed to this position by the felt guide rolls 12 and 13, which are disposed inside the felt 11 or the equivalent on both sides of the press roll 10. The press roll 10 is inside the endless felt 11. From the third nip N3 the paper web is directed by means of the guide roll 14 and the endless fabric to the following step of the paper production. Substantially below the central roll the doctor 20 is disposed, serving as a cleaning member of the central roll 9, and also possibly other devices relating to the press section, such as the spraying members 21.

As is apparent from the above description, and in particular from FIG. 1, the central roll in a compact press section is surrounded by a number of machine elements, which necessarily have to be placed very close to the central roll in order to provide the compact press section. In order to bring the construction of FIG. 1 into service position, the press rolls 8 and 10 as well as the felt guide rolls 12 and 13 have to be removed away from the central roll, in the direction of the arrows 16 and 17. It is of course possible to construct the press section in such a way that only either one of the press rolls needs to be previously displaced in order to bring the central roll 9 into service position. These transfers are performed according to FIG. 2 and the central roll 9 is turned into the upper position by means of the transfer means of the central roll, for example one or a plurality of hydraulic cylinders 18.

Figure 2:
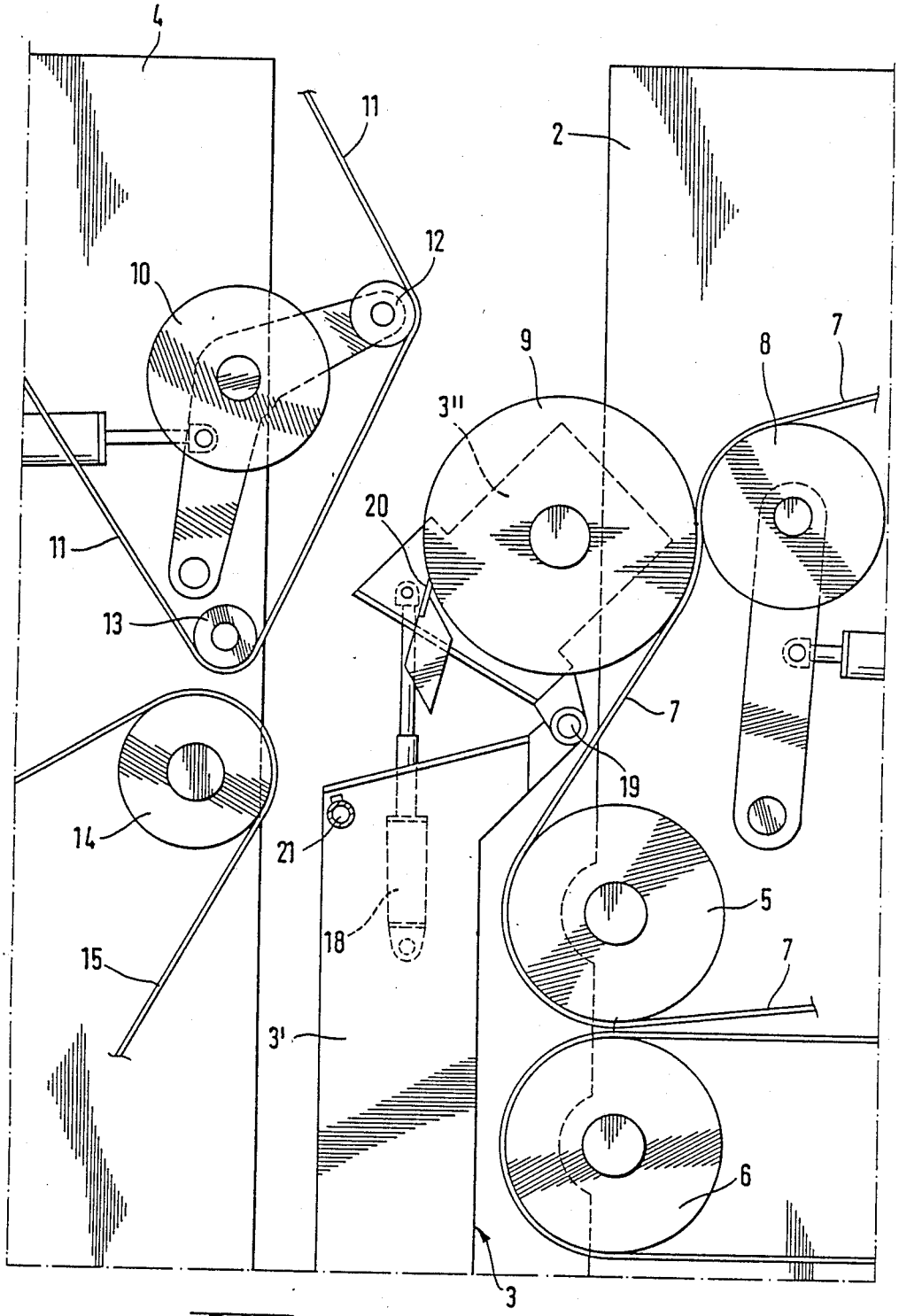
FIG. 2 shows schematically the press section of FIG. 1 in service position.

The central frame section 3 of FIGS. 1 and 2 is constructed in two pieces, comprising a stationary base section 3' as well as the auxiliary frame 3'' articulated rotatably around the joint 19 transverse to the direction of motion of the paper web, to which auxiliary frame the central roll 9 is fixed on bearings. The elements 3' and 3'' comprise members 22, by which they are interlocked to each other, the press section being in its operating position according to FIG. 1. In addition, the transfer means 18 can in some cases be used at least as a part of the interlocking means.

As appearing from FIG. 2, the elements 9, 10, 12, 13, 14, 20 and 21, which in the described construction are very close to each other in the operating position of the press section, are spaced in the service position of the press section, whereby their service and exchange are easy to carry out. For instance the doctor 20 serving as a cleaning member of the central roll 9 and the spraying member 21, being below the central roll in a difficult position to reach below with regard to service, are made very easily serviceable. The doctor 20 and/or spraying member 21 can accompany the central roll during its displacement with respect to the frame of the paper machine, as presented in FIG. 2 on account of the doctor 20. Moreover, the transfer suction roll 14 requiring service is very easily accessible.

Figure 3:
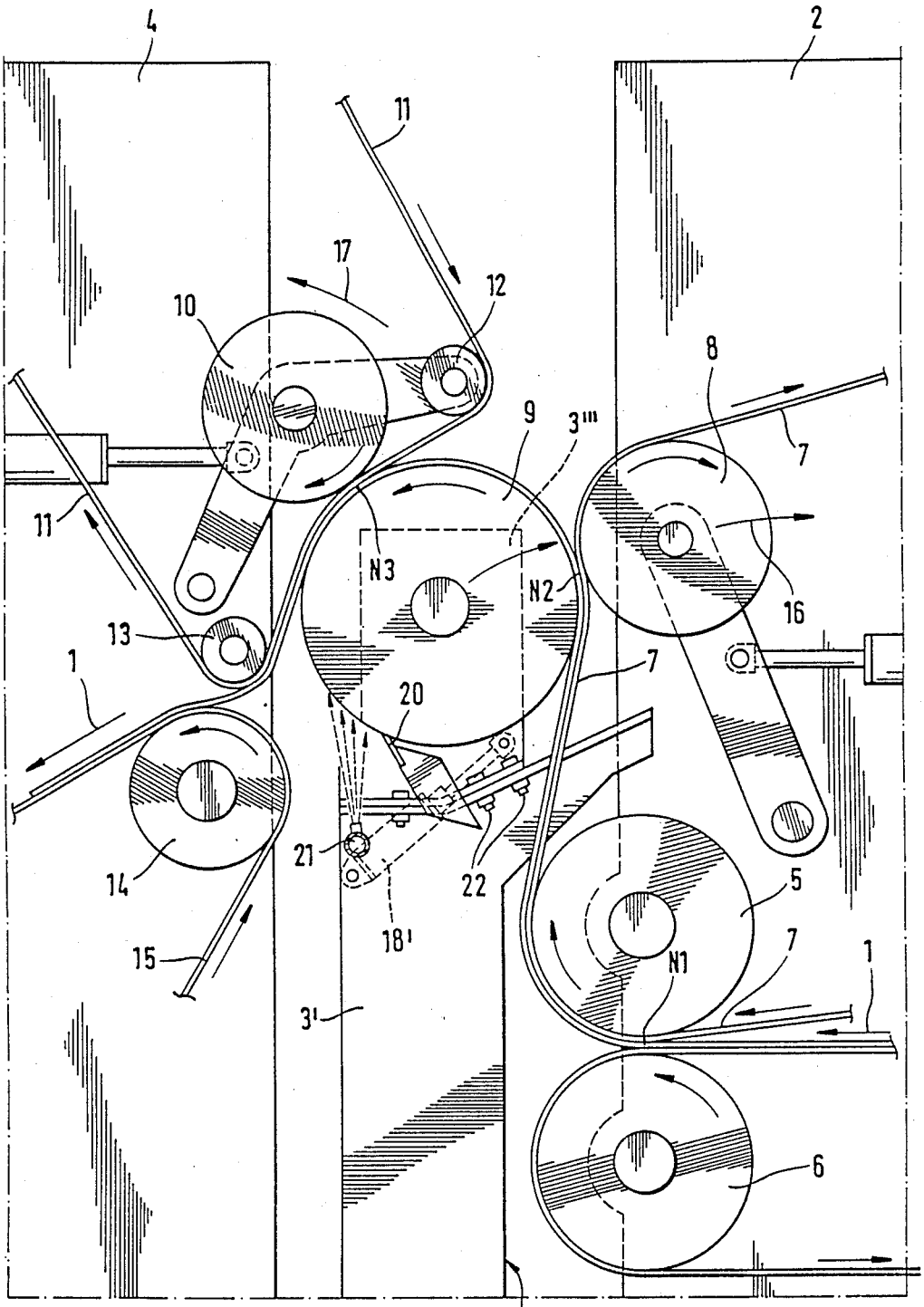
FIG. 3 shows schematically a second embodiment of the press section in operating position.
Figure 4:
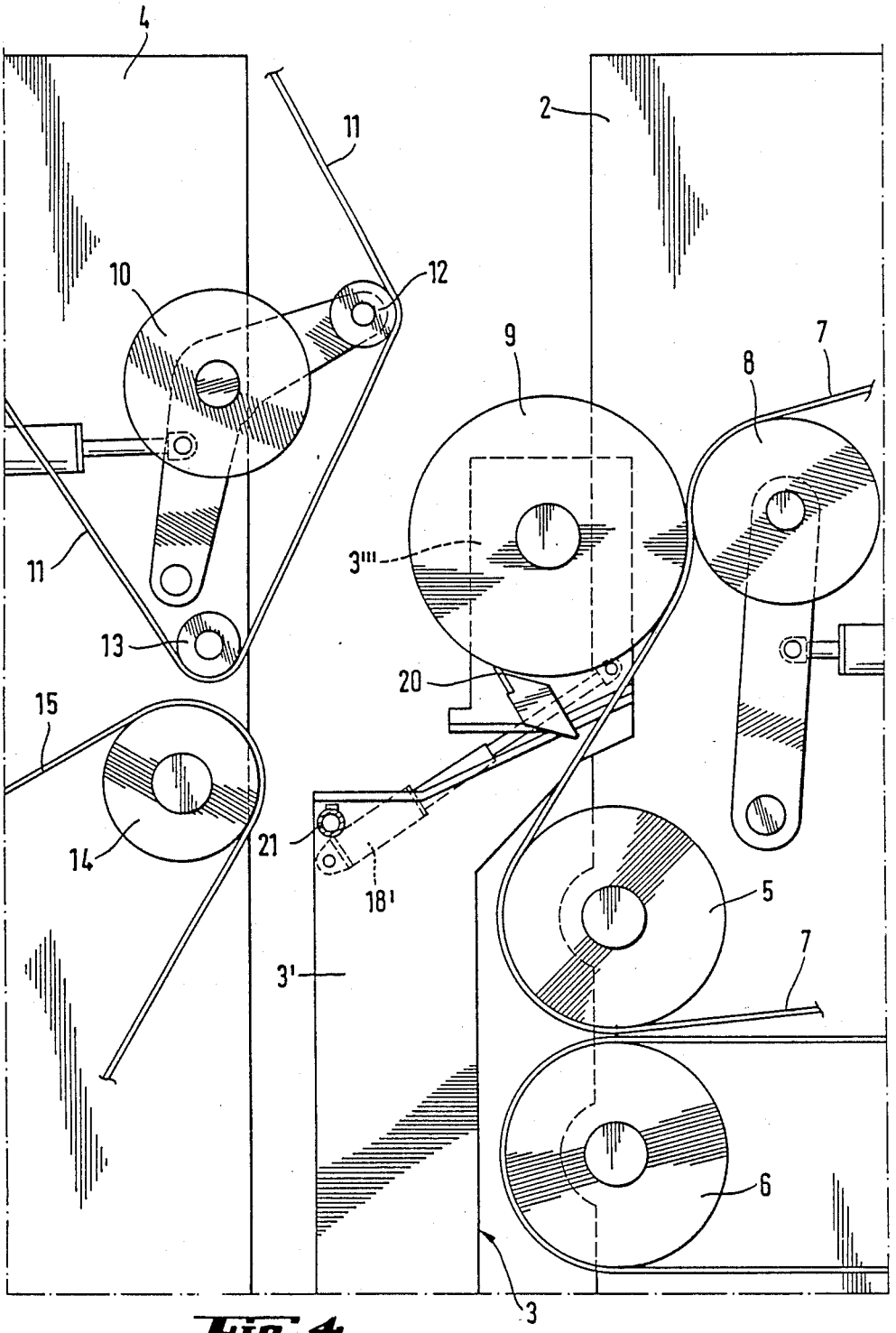
FIG. 4 shows schematically the press section of FIG. 3 in service position.

Another alternative embodiment of the operation according to the invention is to equip the base element 3 of the central frame section 3 with a guide track arrangement 23 according to FIGS. 3 and 4, in the direction of motion of which the auxiliary frame 3'' of the central roll is disposed to be movable for example by an actuator 18' driven by a pressure medium.

A combination of the rotation of FIGS. 1 and 2 and the guide track arrangement of FIGS. 3 and 4 can of course also be used.

The construction according to the invention can consequently be accomplished in various manners. For instance, both the press rolls do not necessarily have to be made displacable between the operating position and the service position with regard to the frame construction. A certain play must in any case be provided in the press rolls 8 and 10 with regard to the central roll 9 in order to adjust the compressing force. By considering such an adjusting margin and by disposing the press rolls with regard to the central roll, such a construction can be achieved.

The press section construction according to the invention can also be adapted in paperboard machines or similar machines, and thus the word "paper machine" in this application should be interpreted as having a larger signification.

The invention is not, either, restricted to frame solutions comprising separately a front frame and a rear frame as described in this application, but can also be applied to constructions in which the front frame and the rear frame form an integral solid construction and in which the felt and roll exchanges and the like are carried out by "floating" from the side of the machine.

I claim:

1. A compact press section in a paper machine, comprising:

a frame construction including a front frame section, a central frame section and a rear frame section;

a roll arrangement including a central roll supported in the central frame section and two press rolls, one of the press rolls supported in the front and rear frame sections, respectively, each of the press rolls forming a nip with the central roll;

wherein the central frame section includes an auxiliary frame portion and a stationary base portion and wherein the central roll is attached to the auxiliary frame portion;

a plurality of press fabrics for guiding the paper web through the press section;

members for guiding at least one of said press fabrics; means for cleaning said at least one central press roll;

transfer means mounted on the stationary base and auxiliary frame portions, for moving the auxiliary frame portion and the central roll supported thereon with respect to the stationary base portion frame construction and at least one of the press rolls between a working and a service position;

interlocking means provided on the stationary base and auxiliary frame portions of the central frame for interlocking the auxiliary frame portion with respect to the frame construction; and a guide track arrangement provided between the stationary base portion and the auxiliary frame portion, the guide track arrangement movably supporting and guiding the auxiliary frame and the central roll on the guide track arrangement as they move with respect to the stationary base portion.

2. A press section according to claim 1, wherein the transfer means further comprises at least one actuator driven by a pressure medium, and provided between the auxiliary frame portion and the stationary base portion, by means of which the central roll is displaceable, with the auxiliary frame portion being supported by the guide track arrangement.

3. A press section according to claim 2, wherein the actuator constitutes an element of the interlocking means.

4. A press section according to claim 1, wherein said means for cleaning the central roll are fixed to the auxiliary frame to move along with the central roll.

* * * * *